United States Patent [19]

Ber-Fong

[11] Patent Number: 4,616,936

[45] Date of Patent: Oct. 14, 1986

[54] CONSTRUCTION OF A FOAMING MACHINE

[76] Inventor: Huang Ber-Fong, 10-4/F, No. 1, Fu Hsing South Rd., Sec.1, Taipei, Taiwan

[21] Appl. No.: 649,015

[22] Filed: Sep. 10, 1984

[51] Int. Cl.[4] ..... B01F 15/02

[52] U.S. Cl. ..... 366/193; 220/260

[58] Field of Search ..... 366/193, 192, 184, 348, 366/349, 42, 43, 68, 341, 347; 222/561, 505; 220/260; 134/150

[56] References Cited

U.S. PATENT DOCUMENTS

| | | | |
|---|---|---|---|
| 2,801,035 | 7/1957 | Hertrich | 222/561 |
| 3,070,357 | 12/1962 | Wilson | 366/193 |
| 3,434,697 | 3/1969 | Carlson | 366/193 |
| 3,822,737 | 7/1974 | Edwards | 366/193 |
| 4,350,444 | 9/1982 | Yargus | 366/193 |
| 4,359,176 | 11/1982 | Johnson | 222/561 |

*Primary Examiner*—Robert W. Jenkins

*Attorney, Agent, or Firm*—Armstrong, Nikaido, Marmelstein & Kubovcik

[57] ABSTRACT

An improved construction of a foaming machine, wherein the bottom of the agitator barrel is provided with a lower cover device so that a control gate provided under the bottom of the agitator barrel can be controlled to move to and fro on the support rails of two side rails, thereby the said control gate can be pushed forwards to close the bottom of the agitator barrel or moved backwards to open the bottom of the agitator barrel. A driving mechanism can control the mixture receiving mold under the agitator barrel so that the latter can be lifted or lowered to effectively reduce the laying down distance between the mold and the agitator barrel. Thus the ununiform bubbles occurred while laying down the mixture by swinging away the lower cover of the agitator barrel in the known foaming machine can be avoided.

3 Claims, 9 Drawing Figures

CONSTRUCTION OF A FOAMING MACHINE

BACKGROUND OF THE INVENTION

The foaming process in a foaming machine is usually operated as follows:

The foaming raw material (such as Polyol) is put in an agitator barrel, the foaming agent (such as Isocyanate) is added and then they are mixed in a high agitating speed. The agitated mixture is poured into a mold to form a shape required for foaming effect.

The operation and construction of the known foaming machine is shown in FIG. 1 and FIG. 2, wherein:

FIG. 1 is a perspective view of the known foaming machine.

FIG. 2 is a graphic view showing the laying down operation by swinging away the lower cover in the known foaming machine.

In use of the known foaming machine, raw material and foaming agent are agitated in the agitator barrel A, then the lower cover B is swung aside by a subsidiary structure. Thus, the agitated mixture in the agitator barrel A will fall into the mold C prepared under the barrel A through the bottom thereof. The mixture then foams in the mold C and swells into required shape.

The greatest disadvantage in using the known foaming machine described above is that: When the lower cover B is opened, the agitated mixture to be foamed pours downwards and rapidly into the mold C and splashes everywhere. The worst effect is that the agitated mixture is so rapidly poured that nonuniform bubbles occur in the product, thus lowering the quality of the product.

In order to avoid the disadvantage induced by the rapid pouring of the agitated mixture, reducing the distance L between the mold C and the bottom of the lower cover B is feasible.

However, in the construction of the know foaming machine, the lower cover B is swung aside to open the bottom of the barrel A. A space must be reserved for the motion of the lower cover B so that it can be opened without a hitch. Therefore, there is a problem in reducing the laying down distance L.

SUMMARY OF THE INVENTION

One object of the present invention is to provide an improved construction of a foaming machine so that the distance between the mold and the agitator barrel can be adjusted suitably and, in the laying down operation, the agitated mixture can be laid down smoothly into the mold as planned. Thereby, the drawback of the rapid pouring of the mixture in the known foaming machine can be avoided.

Another object of the present invention is to provide an improved construction of a foaming machine, wherein a lower cover, which can be withdrawn horizontally to open the bottom of the agitator barrel, is provided under said bottom; a driving mechanism is provided on the machine body so that a support plate can be lifted or lowered under control to suitably adjust the distance between the mold and the bottom of the agitator barrel. Thereby, the agitated foaming mixture can be laid down into the mold very smoothly and the bubbles in the product can be avoided. Therefore, the quality of the product can be heightened.

Other objects, features and efficiency of the present invention can be further understood from the following detailed description.

DETAIL DESCRIPTION OF THE PRESENT INVENTION

Figure 1:
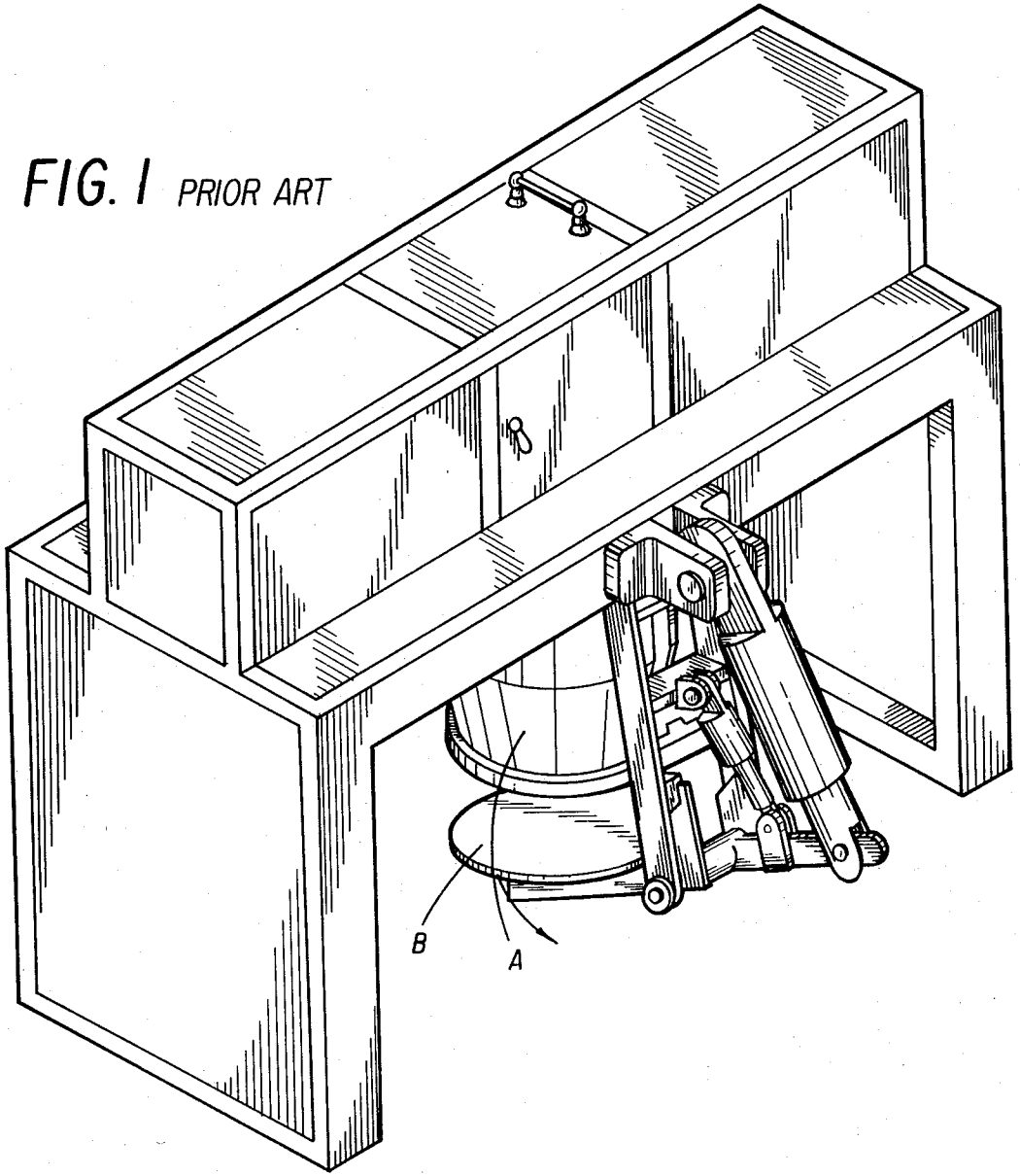
FIG. 1 PRIOR ART
FIG. 1 is a perspective view of the known foaming machine.
Figure 2:
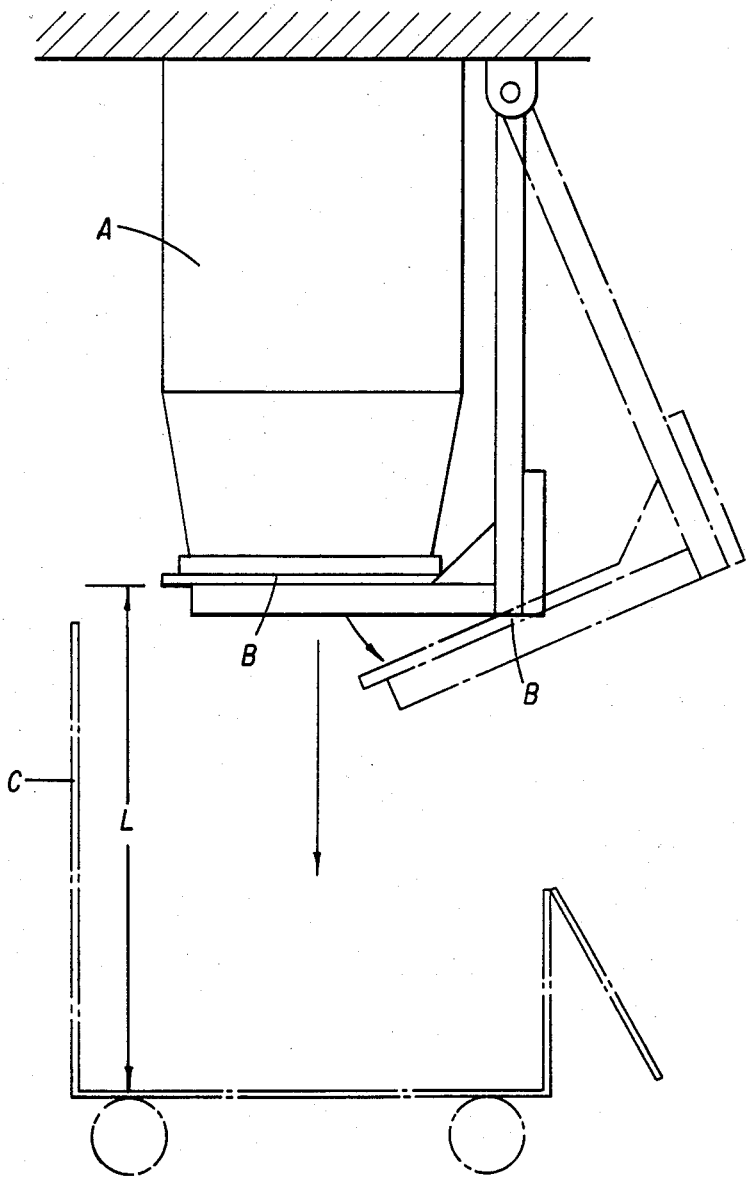
FIG. 2 PRIOR ART
FIG. 2 is a graphic view showing the laying down operation by swinging away the lower cover in the known foaming machine.
Figure 3:
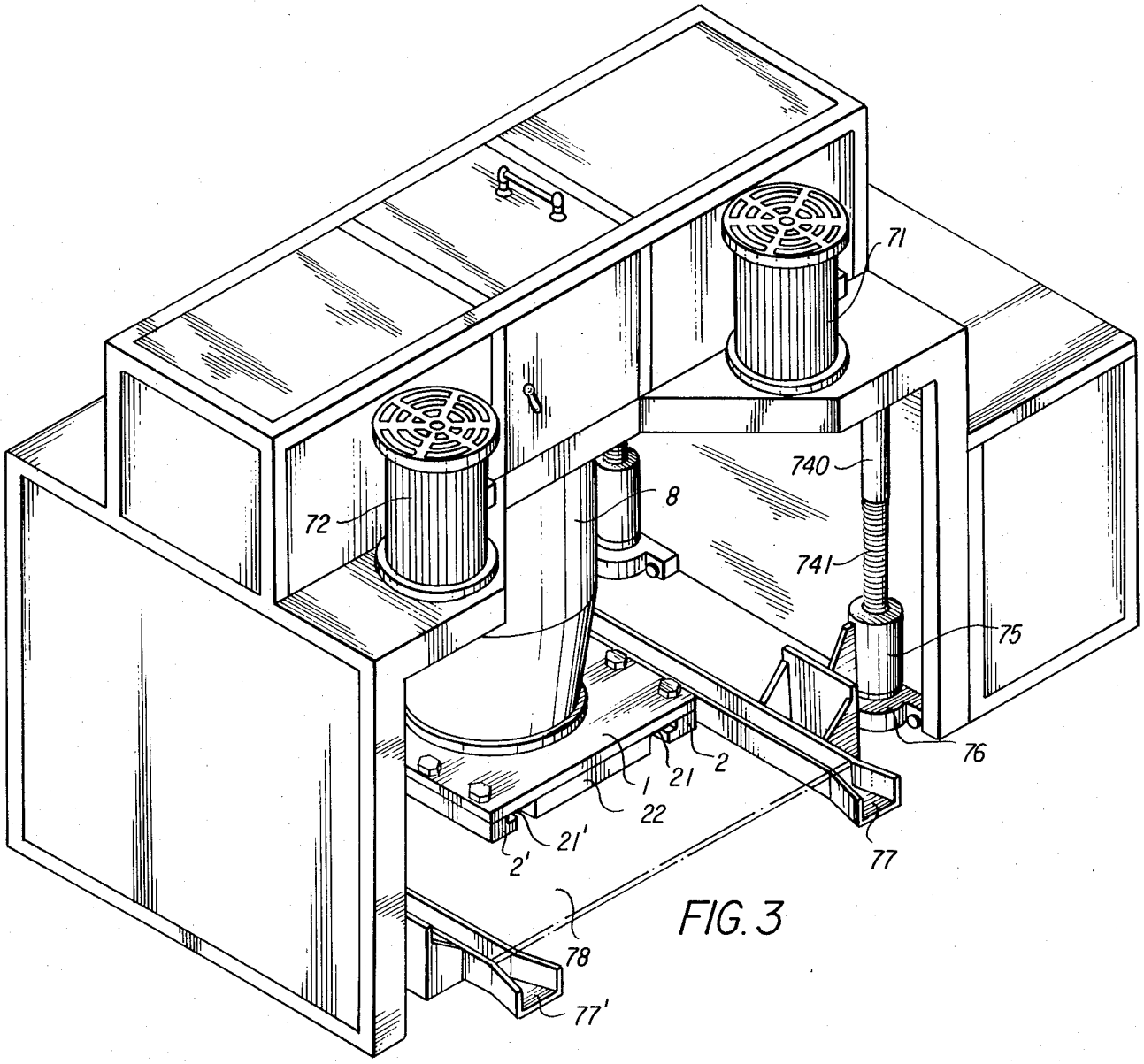
FIG. 3 is a perspective view of the present invention.
Figure 4:
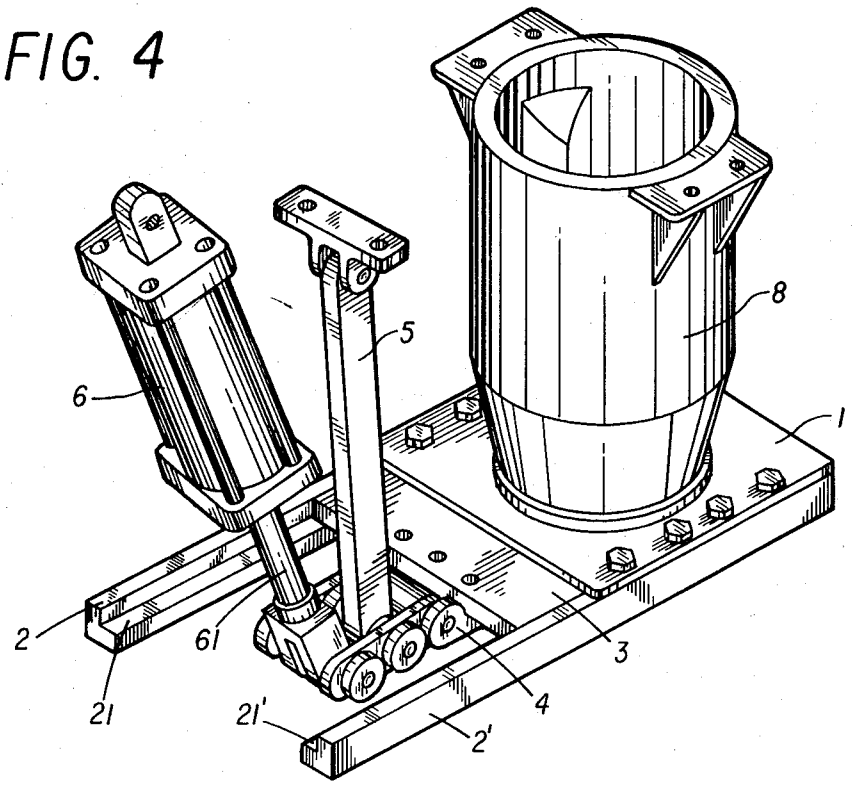
FIG. 4 is a graphic view of the lower cover device of the agitator barrel of the present invention.
Figure 5:
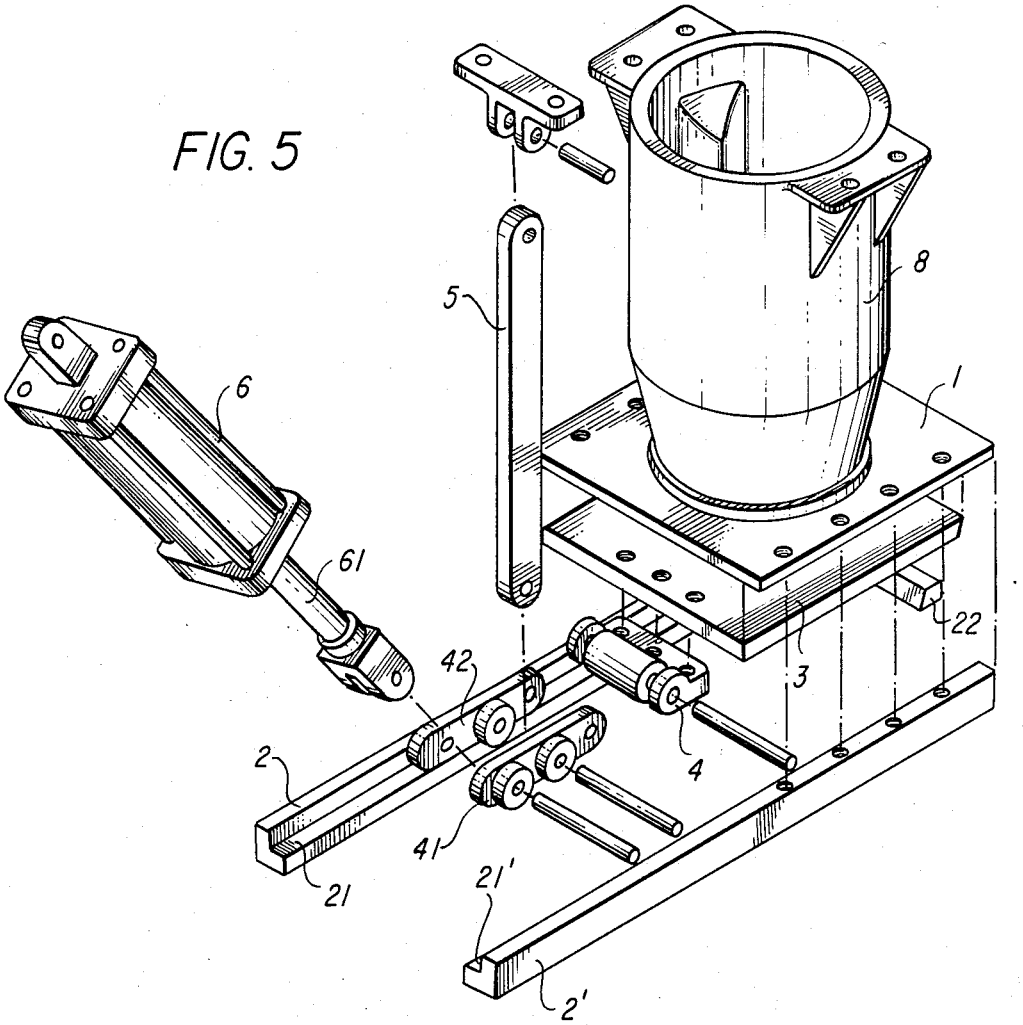
FIG. 5 is an exploded view of the lower cover device of the agitator barrel of the present invention.

Please refer to FIG. 3 FIG. 4 and FIG. 5, the lower cover device of the agitator barrel of the present invention comprises:

a base plate 1 engaged with the bottom of the agitator barrel;

two side rails 2,2' mounted on the two inner bottom sides of the said base plate 1, the said two side rails 2, 2' being provided with two opposed inwardly facing "L" support rails 21, 21' and the said base plate 1 being provided with a cross plate 22;

a control gate 3, which is disposed longitudinally movably in backward and forward directions on the rails 21,21', can be closely engaged with the bottom of the agitator barrel;

a connecting block 4, which is connected to one side of the control gate 3 and engaged with two side connecting plates 41,42 with pins;

a generally vertical connecting rod 5, of which one end is engaged with the two side connecting plates 41, 42 near the middle thereof; and a substantially vertical driving cylinder 6, wherein one end of the driving shaft 61 is connected to the trailing ends of the two side connecting plates 41,42. The other end of connecting rod 5 and driving cylinder 6 are pivotally connected to a fixed member adjacent the agitator barrel 8.

Figure 6:
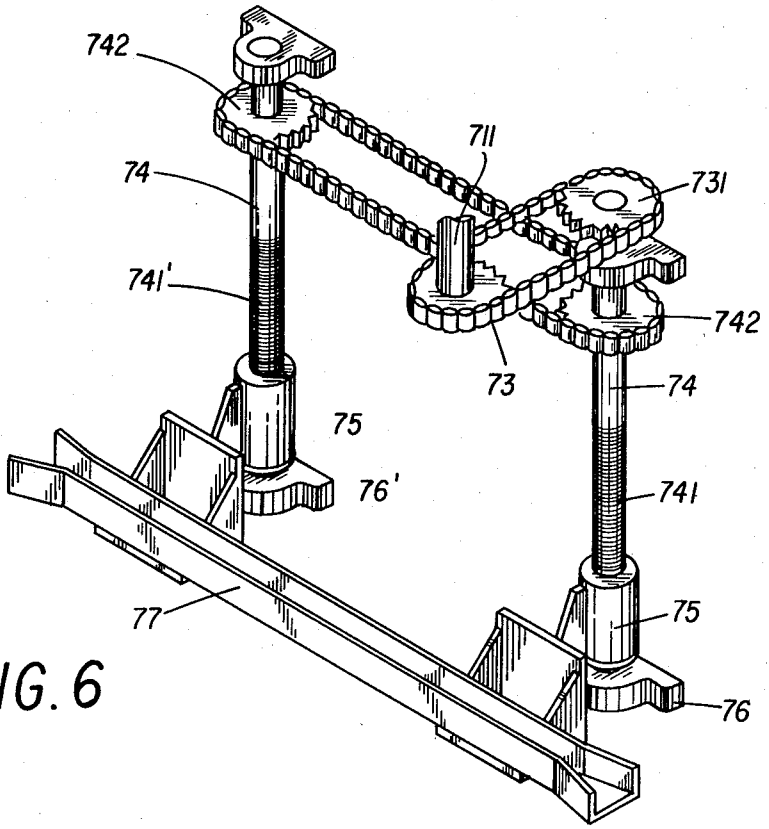
FIG. 6 is a perspective view of the driving mechanism of the present invention.

Please refer to FIG. 3 and FIG. 6, the driving mechanism of the present invention is provided at the two inner sides of the machine body, the said mechanism comprises:

driving motors 71,72 mounted above two sides of the machine body;

driving gear 73 drived by axles 711 of motors, wherein power is transmitted by chains from the said gear 73 to the gear 731 provided on the respective upper ends of lead screws 74;

two sets (only one of them is shown in FIG. 6) of lead screws 74, 74', the bodies of which are provided with screws of suitable length and two gears 742, 742' are provided opposite to a suitable height of the said bodies. The said two gears 742,742' are connected with chains so that when the lead screw 74 is roated, the other respective lead screw 74' follows simultaneously;

bushes 75,75' screwed on the screw bodies 741, 741' of the lead screws 74,74' the said bushes 75,75' being provided with internal threads for matching with the threads on the screw bodies;

fixing seats 76,76' to fix the bottom portions of lead screws 74,74' onto the inner sides of the machine body;

support frames 77,77' engaged with bushes 75,75'; and a support plate 78 which can be disposed over two side support frames 77, 77' onto which a mold can be pushed and disposed.

Figure 7:
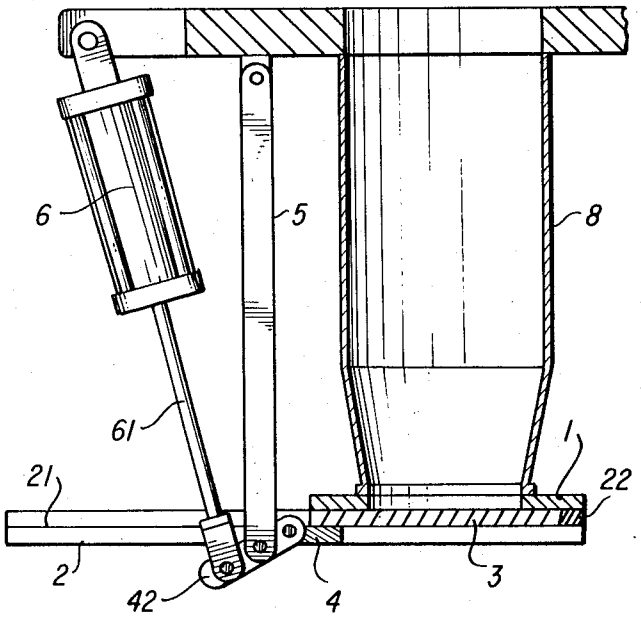
FIG. 7 is a graphic view of the lower cover device in closed position of the agitator barrel of the present invention.

Referring to FIG. 7, when driving shaft 61 is extended, the control gate 3 is pushed and moved forwards along support rails 21, 21' to close the bottom of the agitator barrel 8.

Figure 8:
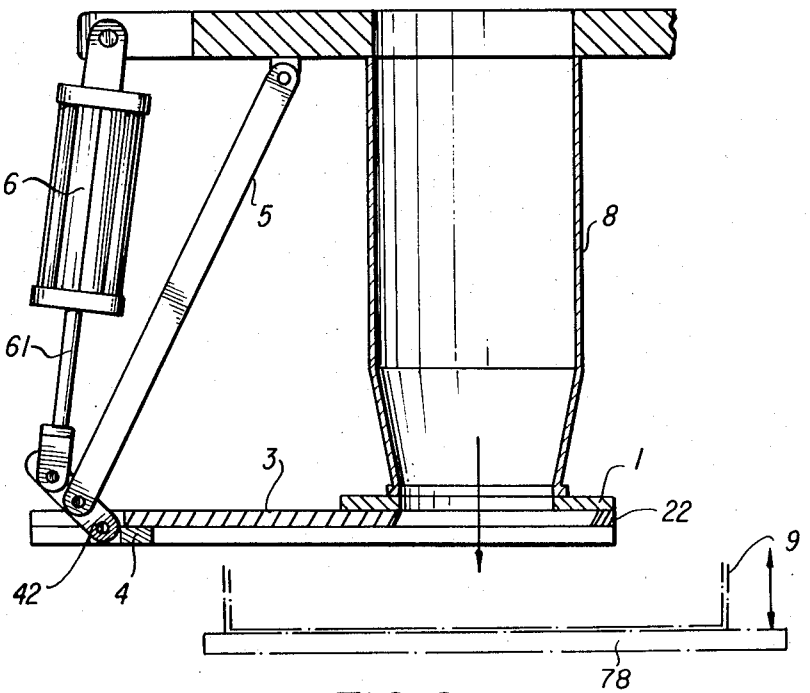
FIG. 8 is a graphic view of the lower cover device in opened position of the agitator barrel of the present invention.

Please refer to FIG. 8, when the driving shaft 61 is actuated to withdraw inwardly, the control gate 3 is moved backwards along support rails 21, 21' to open the bottom of the agitator barrel 8 and the agitated foaming mixture is laid down into the mold 9.

Figure 9:
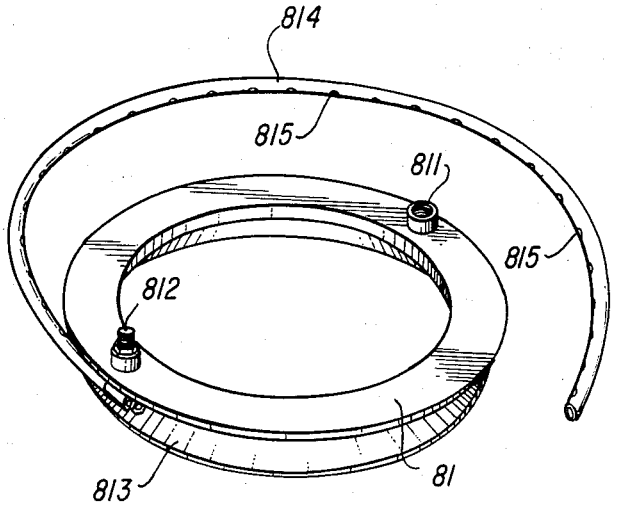
FIG. 9 is a perspective view of the upper cover of the agitator barrel of the present invention.

Please refer to FIG. 9, the upper control cover 81 disposed over the agitator barrel 8 is provided with an inlet 811 and a cleaning hole 812 for foaming agent; a grooved track 813 is circumferentially provided along the lower portion of the said upper cover 81; the lower portion of the cleaning hole 812 is engaged with inlet pipe 814 circumferentially provided over the grooved track 813, the said inlet pipe 814 being provided with a plurality of equally spaced apertures 815. The said upper control cover 81 permits the raw material (such as Polyol) entering the agitator barrel 8 through the main hole and permits the foaming agent (such as Isocyanate) passing through the inlet 811 and evenly entering the agitator barrel 8 through track 813. When cleaning is required, clean water is poured into the pipe 814 through the hole 812 and enters the agitator barrel 8 through equally spaced apertures 815 for effectively cleaning the interior of the barrel 8.

Please refer to those drawings, after the mixture is agitated in the agitator barrel 8, it can be laid down, if desired, by actuating motors 71,72 so that the gear 73, 731 are drived by the respective axles 711 and lead screws 74 are rotated simultaneously. The other lead screws 74' are rotated simultaneously through respective gears 742, 742'. Owing to the engagement of the threads, the bushes 75,75' will thus be lifted. Meanwhile, the two side support rails 77, 77' and the support plate 78 thereon will be lifted also so that the mold 9 on the support plate 78 is raised near the bottom of the agitator barrel 8. Thereby the distance between the bottom of the agitator barrel 8 and mold 9 is reduced. At this time, the driving shaft 61 is actuated to withdraw inwardly and the control gate 3 is moved back along support rails 21, 21' to open the bottom of the agitator barrel 8. After the mixture is laid down completely, the mold 9 is pushed out and the foamed product required is readily obtained.

Because the control gate 3 is horizonally and straightly moved to and fro along support rails 21, 21' to open or close the bottom of the agitator barrel 8, there can be room for the mold 9 to be lifted or lowered vertically. Thereby, the distance between the bottom of the agitator barrel 8 and the mold 9 can be reduced effectively while laying down the mixture. Therefore, the agitated mixture can be laid down freely and smoothly into the mold 9 through a reduced distance so that the mixture will not be poured rapidly and splashed everywhere. Thus the nonuniform bubbles that occur while laying down the mixture in the known agitating machine can be avoided by using the construction of the present invention and consequently the quality of the product can be heightened. Therefore, the present invention has practical application.

I claim:

1. A lower cover device for a foaming machine which includes an agitator barrel having an open bottom, comprising:

a base plate having an aperture therein attached to the bottom of said agitator barrel, said base plate being provided on bottom edges thereof with a pair of opposed inwardly facing L-shaped support rails and a cross plate therebetween at one end;

a control gate supported between said support rails for longitudinal horizontal motion thereon; and driving means for said control gate comprising a connecting block pivotally attached to one end thereof, a generally vertical connecting rod pivotally connected to said connecting block and to a fixed member adjacent said agitator barrel, and a substantially vertical driving cylinder similarly connected to said connecting block and said fixed member and operable to move said control gate forward on said support rail to cover said aperture and to move said support gate backward on said support rails to open said aperture at the bottom of said agitator barrel.

2. A lower cover device as recited in claim 1, further comprising a means for supporting a mold under said agitator barrel, said means comprising:

a support plate arranged beneath said agitator barrel for vertical movement with respect thereto; and bushes engaged with said support plate and provided with internal threads, lead screw means having screw bodies engaged in said internal threads of said bushes, and rotor means operatively connected to said lead screw means for rotating same to raise and lower said support plate, whereby a mold disposed on said support plate may be raised to reduce the distance between said mold and the bottom of said agitator barrel.

3. A device as recited in claim 1, wherein said agitator barrel further includes an upper control cover including an inlet connected therethrough to a circumferential grooved track, and a cleaning means for said upper control cover comprising a cleaning hole extending into said circumferential grooved track and an inlet pipe connected to said cleaning hole and positioned in said grooved track, said inlet pipe being provided with a plurality of equally spaced apertures whereby water introduced into said inlet pipe through said cleaning hole may enter said agitator barrel through said apertures for cleaning the interior of said agitator barrel.

* * * * *